United States Patent [19]

Vissing

[11] Patent Number: 4,520,921

[45] Date of Patent: Jun. 4, 1985

[54] METHOD AND APPARATUS FOR CLOSING CYLINDRICAL CONTAINERS

[76] Inventor: Ellin D. Vissing, P.O. Box 437, Idaho Falls, Id. 83401

[21] Appl. No.: 592,887

[22] Filed: Mar. 23, 1984

[51] Int. Cl.[3] ..... A45C 13/10

[52] U.S. Cl. ..... 206/1.5; 220/306; 220/326

[58] Field of Search ..... 220/326, 306, 307; 206/1.5

[56] References Cited

U.S. PATENT DOCUMENTS

| | | | |
|---|---|---|---|
| 3,175,853 | 3/1965 | Gilbertson | 220/326 |
| 3,485,408 | 12/1969 | Benesch | 220/326 |
| 4,101,027 | 7/1978 | Kohl et al. | 206/387 |

FOREIGN PATENT DOCUMENTS

| | | | |
|---|---|---|---|
| 1586980 | 1/1979 | Fed. Rep. of Germany | 220/281 |
| 18004 | 10/1912 | United Kingdom | 220/281 |

*Primary Examiner*—Joseph Man-Fu Moy

*Attorney, Agent, or Firm*—Herbert C. Schulze

[57] ABSTRACT

This invention is a method, and apparatus for practicing said method, wherein cylindrical containers may be closed in an unusual and highly controllable manner, especially by persons who may have difficulty using their fingers in normal fashion, by means of first specially designed container chamber portion connectable to a second chamber closing portion wherein the two different pieces of apparatus are so constructed and so interact that by appropriate turning and the formation of the two parts the two parts can be caused to safely interlock, but at the same time can be formed for relative ease of opening. Included are the method for closing by a deformation together with twisting action and two matching portions which can operate cooperatively as described.

2 Claims, 5 Drawing Figures

FIG. 1.
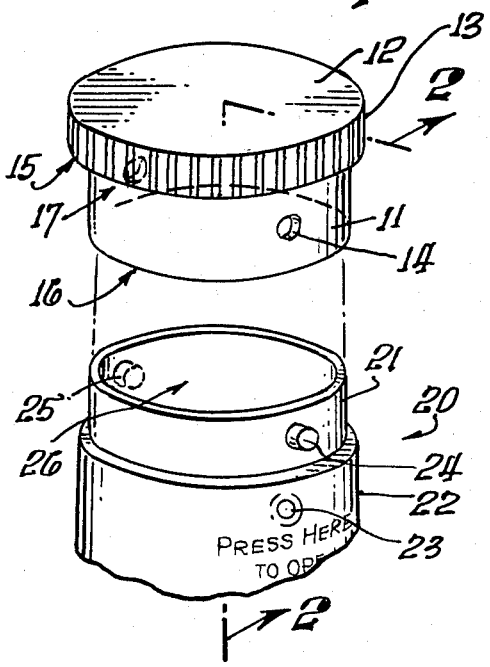
FIG. 2.
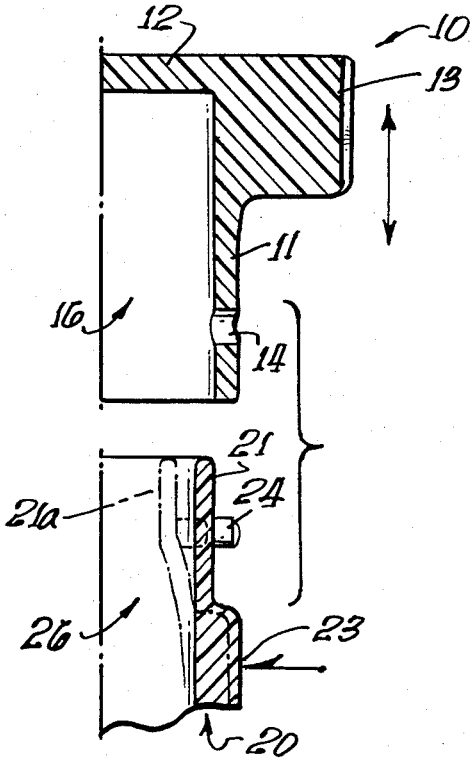
FIG. 4.
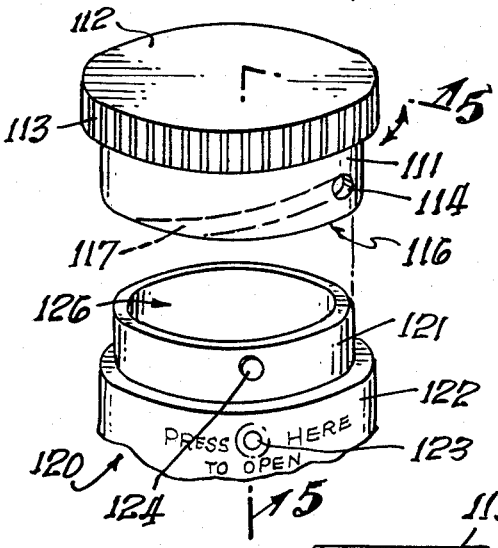
FIG. 3.
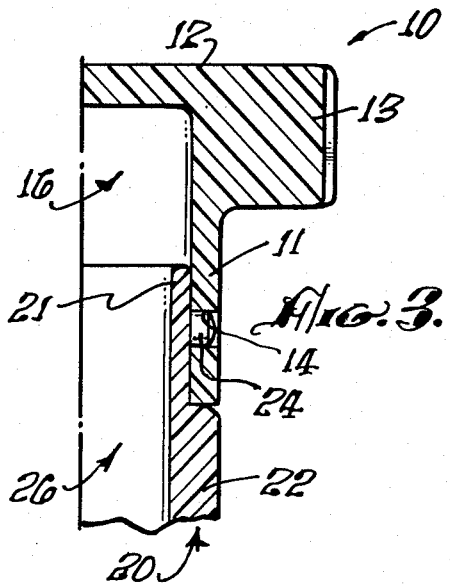
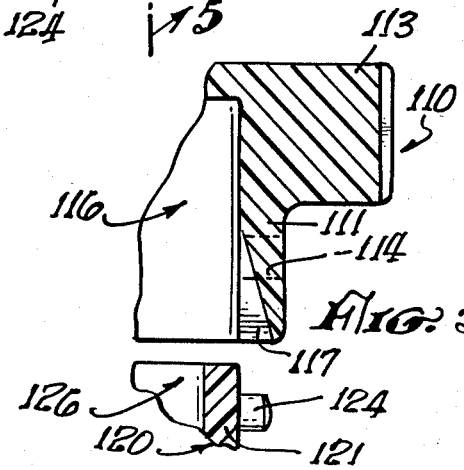
FIG. 5.

METHOD AND APPARATUS FOR CLOSING CYLINDRICAL CONTAINERS

BACKGROUND OF THE INVENTION

I. Field of the Invention

This invention is in the general field of closures for cylindrical containers and is more particularly related to a deformable cylindrical container which, upon proper manipulation, can be caused to be closed by a cooperating cap portion which portion is also deformable and the two portions have means to firmly lock the two in a closed condition when desired. The invention further related to the method of so locking two deformable portions of a container together and unlocking them.

II. Description of the Prior Art

There is no prior art known to me which would be directly readable upon this invention. I have previously worked in the field of closures for containers and I have obtained U.S. Pat. No. 3,187,794 which describes a unique iris type closure arrangement. In developing that item there were some of the thoughts in mind for the present invention, but the present invention now incorporates a cap having different features than that in my patent, particularly as to the locking ability, and the cap could conceivably be used with an iris type closure such as I described in my said U.S. Pat. No. 3,187,794, but it is of much broader and wider use in that it can customary cap as is shown and illustrated in this particular application, capable of being used on any type of cylindrical container.

SUMMARY OF THE INVENTION

The field of containers, particularly for medicines and other materials is quite large and over the years there have been many developments directed at closures which can be relatively tamper proof for children but which can be utilized by adults without too great an effort. Unfortunately virtually all of the tamper proof type containers are difficult to manipulate for persons with arthritis or other such ailments.

Likewise, many of the so called tamper proof items require a simple pressure on their top or similar type action which is easily understood by and utilized by children to defeat the tamper proof thought.

My previously referred to U.S. Pat. No. 3,187,794 was a partial answer to some closures for such containers.

However, even my invention left a wide void in the art of closures for such containers which needed to be filled. Thus, I have continued to develop and invent along these lines until I have finally discovered a most important element for satisfactory closure embodying my unique principles.

I have discovered that by forming a semi rigid type container and cap portion with a special mating relationship I can achieve excellent locking closure results, heretofore not possible. I am able to form a locking relationship between the two parts of the bottle on which the locking mechanism may be easily locked and unlocked by an adult with reasonable intelligence while most children of the ages desired to be kept away from the contents of the container will not quite understand nor easily activate the cap when in locked position.

The tubular closure member being formed the way it is as hereinafter described is suitable to be used to close the top of a container on to the bottom of a container for a wide variety of purposes of containment of medicinal of other articles.

I have accomplished the desired results, as mentioned, by deformable portions which have interlocking devices and which can incorporate either a ramp like arrangement to reach the closure or can alternately be used without the ramp type arrangement.

It is an object of this invention to provide a closure for medicinal bottles, containers and the like wherein the closure may be easily locked in position in such manner that it can not readily be unlocked.

Another object of this invention is to provide such an apparatus as described, together with a method for closing containers wherein persons with arthritis or other ailments effecting their fingers can still easily operate the apparatus.

Another object of this invention is to provide such a method and apparatus as is described wherein it may be alternately caused to lock and unlock completely by the incorporation of a turning movement or without such turning movement.

The foregoing and other objects and advantages of this invention will become apparent to those skilled in the art upon reading the following description of a preferred embodiment in conjunction with a review of the appended drawings.

BRIEF DESCRIPTION OF THE DRAWINGS

FIG. 1 is a fragmentary prospective with certain portions in phantom, of a container and its closure apparatus suitable to practice the method of this invention, said portions being in an unclosed mode in FIG. 1;

FIG. 2 is an enlarged section on 2—2 of FIG. 1;

FIG. 3 is the view of the portions of FIG. 2 but in a closed and locked condition;

FIG. 4 is a view similar to FIG. 1, but illustrating a alternate form in phantom;

FIG. 5 is an enlarged section on 5—5 of FIG. 4.

DESCRIPTION OF A PREFERRED EMBODIMENT

FIG. 1 illustrates a cap 10 comprising a cylindrical portion 11 with an enlarged upper edge 13 for easy gripping having knurled or otherwise shaped exterior for easy gripping, and a top 12.

A hole 14, or two holes 14 and 17 may be provided as indicated. The lower portion of the container generally 20 will have its main body portion 22 and a reduced thickness area 21 having a protruding boss 24 and if desired a second protruding boss 25. Normally this apparatus will have a marking of some type at 23 to indicate the possibility of deforming by pressing at that portion. The interior of the container 26 will contain whatever material are desired to be contained in the item.

FIG. 2 is a section which illustrates the top 12 of the cap, the enlarged portion 13, the main portion 11, and the hole 14. The interior of the cap portion is indicated at 16. The container itself consisting of main body portion 22 and reduced thickness 21 are illustrated with the boss 24 which will become inserted into the hole 14. The reduced thickness area and a portion of the main area of the container is shown in phantom the reduced portion 21 a showing how it is deformed when pressure is applied to the pressure point 23 so that the cap 10 can slip over the container 20 and when pressure is released from pressure point 23 the boss 24 will enter the hole 14.

The condition when closed completely is shown at FIG. 3 with all of these elements appropriately in place.

In operation, the container is pressed at its pressure point 23 and if there are two of the locking devices 24 and 25 then of course the pressure will be across from both sides of the container and the situation illustrated in FIG. 2 can occur at both sides of the container. The cap is then placed appropriately over the deformed opening of the container after which the bosses are allowed to slip into their respective receiving holes when the pressure is released.

Another way by which this can be accomplished, and one which can make for greater ease of application but at the same time complicate the process for children or the like trying to open the container is illustrated in FIGS. 4 and 5. In this case the cap consisting of body portion 111 top 112 enlarged portion 113 locking hole 114 and a tapered receiving ramp 117 comprise the entire cap portion 110. The bottom portion is essentially the same as that shown in the previous illustration comprising main body 122, reduced thickness portion 121 having a boss 124 and an indication of a position to press at 123. The opening of this entire lower portion of the container 126 has been indicated. Thus the entire portion 120 becomes quite similar to the previously illustrated portions 20.

The FIG. 5 is shown how through the tapered ramp 117, the cap can be inserted over the boss 124 and then by turning boss 124 will be led through the tapered ramp 117 until it slips into the receiving hole 114 at which point it is locked. For removal it will be necessary to not only apply the pressure and force the boss 124 out of its receiving hole 114, but also to turn the cap 110 so as to remove it from the container portion 120.

While the embodiments of this invention shown and described are completely capable of achieving the objects and advantages desired, it is to be understood that such embodiments have been set forth for the sole purpose of illustration and are not for purposes of limitation.

I claim:

1. A container for pharmaceuticals and the like comprising in combination:

a first cylindrical member having one end closed and one end open formed of a deformable material, and having a portion of said first cylindrical member adjacent its open end with a reduced wall thickness compared to the balance of the wall thickness of said first cylindrical member, a boss extending outwardly a distance from one position on said reduced thickness;

a second cylindrical member having a closed end with an enlarged flange and an open end, said cylindrical member being formed of a deformable material, and the interior dimension on said second cylindrical member being suitable to receive the reduced thickness portion of said first cylindrical member, and having an opening in its cylindrical wall suitable to accommodate the boss on said first cylindrical member, and wherein said second cylindrical member has a spiraling and tapering ramp extending from the outer edge adjacent the open end of said second cylindrical member but on the interior thereof to an innerconnection with said opening in such manner that the boss on the first cylindrical member may be engaged within said ramp and by twisting the said second cylindrical member about the first cylindrical member the boss will ride up the ramp and snap into position within the opening in said second cylindrical member.

2. The method for manufacturing tamper proof lockable two part cylindrical containers for medicine and the like comprising:

forming a first cylindrical container member open at one end and closed at its other end said cylindrical member having a substantial wall thickness;

forming a circumferential portion on said cylindrical member having a reduced wall thickness compared to the major portion of the cylindrical container;

forming a protruding boss protruding from the reduced wall thickness for approximately the distance which would comprise the difference between the main container wall thickness and the reduced thickness area;

forming a second cylindrical member having one end closed and having a substantial thickness to the cylindrical member;

forming a tapering and spiraling ramp extending on the interior of the said second cylindrical member from the opening therein to a point adjacent the open end of the second cylindrical member in such manner that the boss on said first cylindrical member may be engaged with said ramp at its position adjacent the edge of the open edge of said second cylindrical member;

forming an opening in the wall thickness of the cylindrical portion at a position on said ramp suitable to accommodate with and meet with the protruding boss on the first described cylindrical portion.

* * * * *